United States Patent [19]

Back

[11] 4,032,394

[45] June 28, 1977

[54] METHOD OF MAKING WET-PRESSED FIBERBOARD OF HIGH RESISTANCE TO BENDING

[76] Inventor: Ernst Ludvig Back, Vikbyvagen 42, S-181 43 Lidingo, Sweden

[22] Filed: May 20, 1975

[21] Appl. No.: 579,243

[30] Foreign Application Priority Data

May 20, 1974 Sweden ..... 7406675

[52] U.S. Cl. ..... 162/164 R; 162/165; 162/185; 162/215; 162/225; 162/336

[51] Int. Cl.[2] ..... D21H 3/36; D21H 5/02

[58] Field of Search ..... 162/188, 194, 206, 212, 162/215, 219, 225, 231, 222, 165, 164 R, 109, 125, 127, 129, 336, 343, 347, 185; 264/113; 428/218

[56] References Cited

UNITED STATES PATENTS

| | | | |
|---|---|---|---|
| 1,687,140 | 10/1928 | Pleyer | 162/188 X |
| 1,780,623 | 11/1930 | Loetscher | 162/188 |
| 1,821,209 | 9/1931 | Darrah | 162/206 X |
| 3,243,340 | 3/1966 | Cadotte | 162/165 X |
| 3,391,233 | 7/1968 | Polovtseff | 264/113 |
| 3,493,463 | 2/1970 | Baker | 162/188 X |
| 3,665,065 | 5/1972 | Hass et al. | 264/113 |
| 3,969,561 | 7/1976 | Marshall | 428/218 X |

FOREIGN PATENTS OR APPLICATIONS

| | | |
|---|---|---|
| 332,514 | 8/1971 | Sweden |

*Primary Examiner*—S. Leon Bashore
*Assistant Examiner*—Richard V. Fisher
*Attorney, Agent, or Firm*—Oblon, Fisher, Spivak, McClelland & Maier

[57] ABSTRACT

Wet pressed fiber board material of high resistance to bending is produced by preparing a layer of fiber from a water suspension of the fiber, said layer being dewatered and pressed to form a coherent flat sheet, wherein raw material is distributed over the surface of said layer in varying quantities and/or qualities in a manner such that the pressed board obtains strip-like surface portions which extend in at least one direction of the horizontal plane of the sheet, said strip-like surface portions having varying density and/or strength properties, whereby the finished board has a higher resistance to bending than a homogeneous sheet having substantially the same average density.

11 Claims, 3 Drawing Figures

METHOD OF MAKING WET-PRESSED FIBERBOARD OF HIGH RESISTANCE TO BENDING

The present invention relates to wet-pressed, building board material of the type which is manufactured from fibers, and in particular from fibers of a lignocellulosic material, such as wood.

An object of the invention is to provide a method of manufacturing a lower density board material of the beforementioned type which has a much greater resistance to bending, i.e., high bending stiffness, than other board materials of this kind at substantially the same density.

This object is achieved in that the fibrous, wet-pressed board material is manufactured in a manner such that strip-like mat or area portions are formed in at least one of the two main directions of the horizontal plane of said board, normally in the machine direction, said strip-like portions being divided into two groups of which one group has a different density and/or different fiber material than the other, the width of said mat or area portions being optional.

The method according to the invention principally resides in the fact that when manufacturing fiber building board by forming a layer from a fiber suspension and pressing said layer into a coherent sheet-like product of substantially uniform thickness, the supply of fiber material to different portions of the layer is varied so that, subsequent to the final pressing operation, strip-like mat or area portions of different characteristics are obtained which extend in at least one direction in the plane of the board.

In accordance with one embodiment of the invention this result is obtained by distributing the fiber material in the layer in varying quantities over the surface thereof so that, subsequent to pressing the board material, strip-like mat or area portions of different density are obtained.

A number of advantages are to be obtained with the provision on said layer of strip-like mat portions of which respective ones have a low and high density. As mentioned previously, the primary advantage obtained hereby is that it is possible to manufacture boards having a high resistance to bending without excessively increasing the density of the board. If the mat portions of high density are correctly oriented with respect to the use to which the finished board is to be put, it is also possible to provide at subsequent cutting edges a particularly improved edge-density with respect to the remaining portions of the board. Because of this high density of the material at the edges of the board, the edges are more readily painted and offer a much stronger anchoring surface for screws and similar securing or fastening devices. This is particularly true when screws are to be fastened in or adjacent to, for example, sawn edges, for example when cupboards or the like comprising fiber-board are to be assembled, or when hinges are to be fastened to cupboard doors etc. This advantage afforded by the edge portions of higher density also applies to the manufacture of tongue-and-groove means on boards and to the strength properties of this and similar fitting-type attachment means.

With respect to the orientation on the board of the area portions of low and high density, for the manufacture of furniture or the manufacture of cut-to-size wall boards from the finished board material, the board can be provided by way of the high and low density portions with, e.g. strip or square patterns of greatly varying design, particularly in the machine direction of the board, in which direction the patterns can be readily varied.

The strip-like mat portions of the board are suitably divided so that a number of mat portions have a different density to the remainder, the density of the more dense mat portions being at least 20%, and preferably at least 30% greater than the density of the less dense mat portions. The less dense mat portions may have a density which is normal for the present day manufacture of fiber building board of medium density, i.e. a density ranging from about 500 to 750 kg/m$^3$, while the denser mat portions may have a density within the range of 750–900 kg/m$^3$. In the U.S. specifications of AHA (American Hardboard Association), this building board is called hardboard.

For the purpose of obtaining the desired increase in bending resistance without excessively increasing the average density of the board material, the denser material may suitably comprise a minor portion of the whole of the board material, and to this end the materials of different density are suitably distributed so that the area portions of higher density comprise 10–50%, preferably 15–30% of the total surface area of the board material.

In accordance with another embodiment of the invention, the same result is obtained by applying fibers of different quality, with respect to their properties of mechanical strength, to different portions of the layer, in which case the density may be the same in all portions of the finished fiber board. The advantages referred to in conjunction with the first embodiment are also obtained with this embodiment.

In this latter instance, there are suitably used two different fiber qualities, wherein one fiber quality provides a mechanical strength which is at least 10% greater than that provided by the other. Also in this case the two materials are distributed so that the mat portions of higher mechanical strength comprise 10–50%, preferably 15–30% of the total surface area of the board material. The board, for example, is produced with a normal density for boards of medium density of 550 – 750 kg/m$^3$ in all portions thereof.

The two before described embodiments may also be combined in a manner so that the denser portions of the board are constructed of a higher quality raw material than the less dense portions, for example a fiber raw material which has been beaten to a greater extent than the raw material used for the less dense portions. It is also suitable to provide the denser portions with a larger content of binding agent than the less dense portions, such as a thermosetting binding agent.

Methods for the wet-manufacture of fiber building board are well known per se. In such methods a suspension of fibers, optionally mixed with binding agent, is distributed through an inlet box or flow box to form a layer on a moveable wire screen of a sheet-forming machine, the layer being partially de-watered on the wire screen to obtain a coherent web. The edges of the web are then trimmed and the web is cut into sheets which are subsequently pressed under high pressure and a high temperature to obtain the finished boards.

Figure 1:
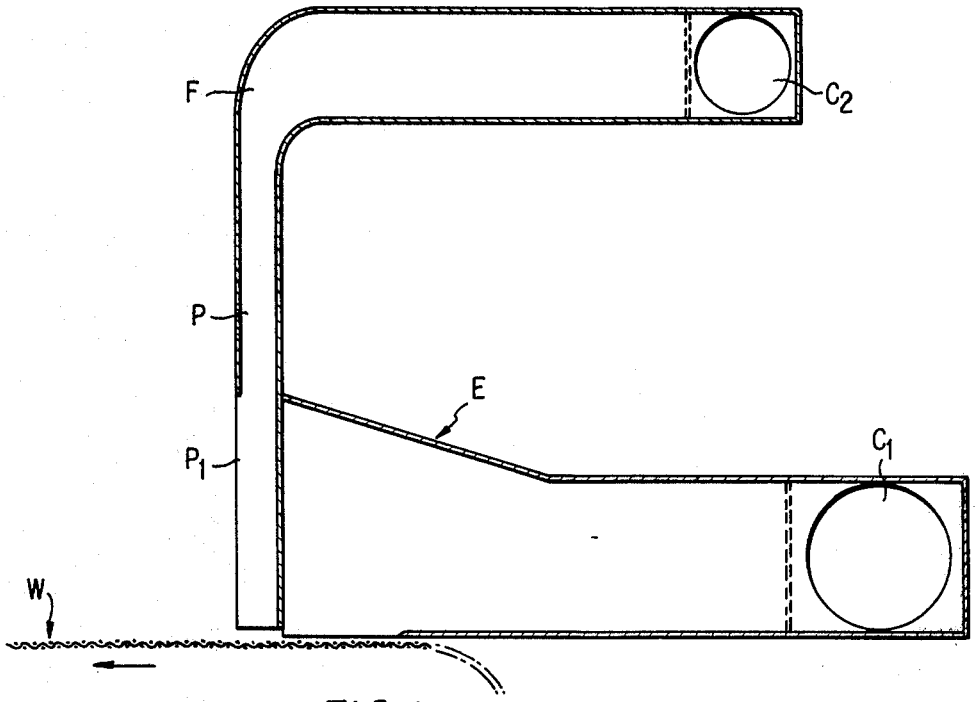
FIGS. 1, 2 and 3 illustrate an apparatus for performing one embodiment of the process of the present invention.
Figure 2:
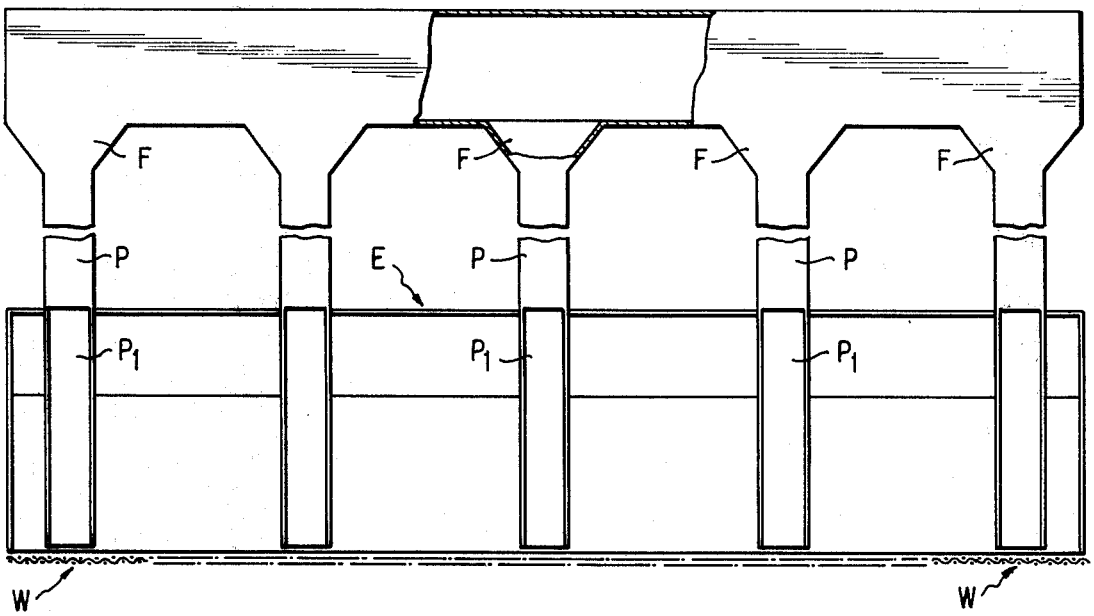
Figure 3:
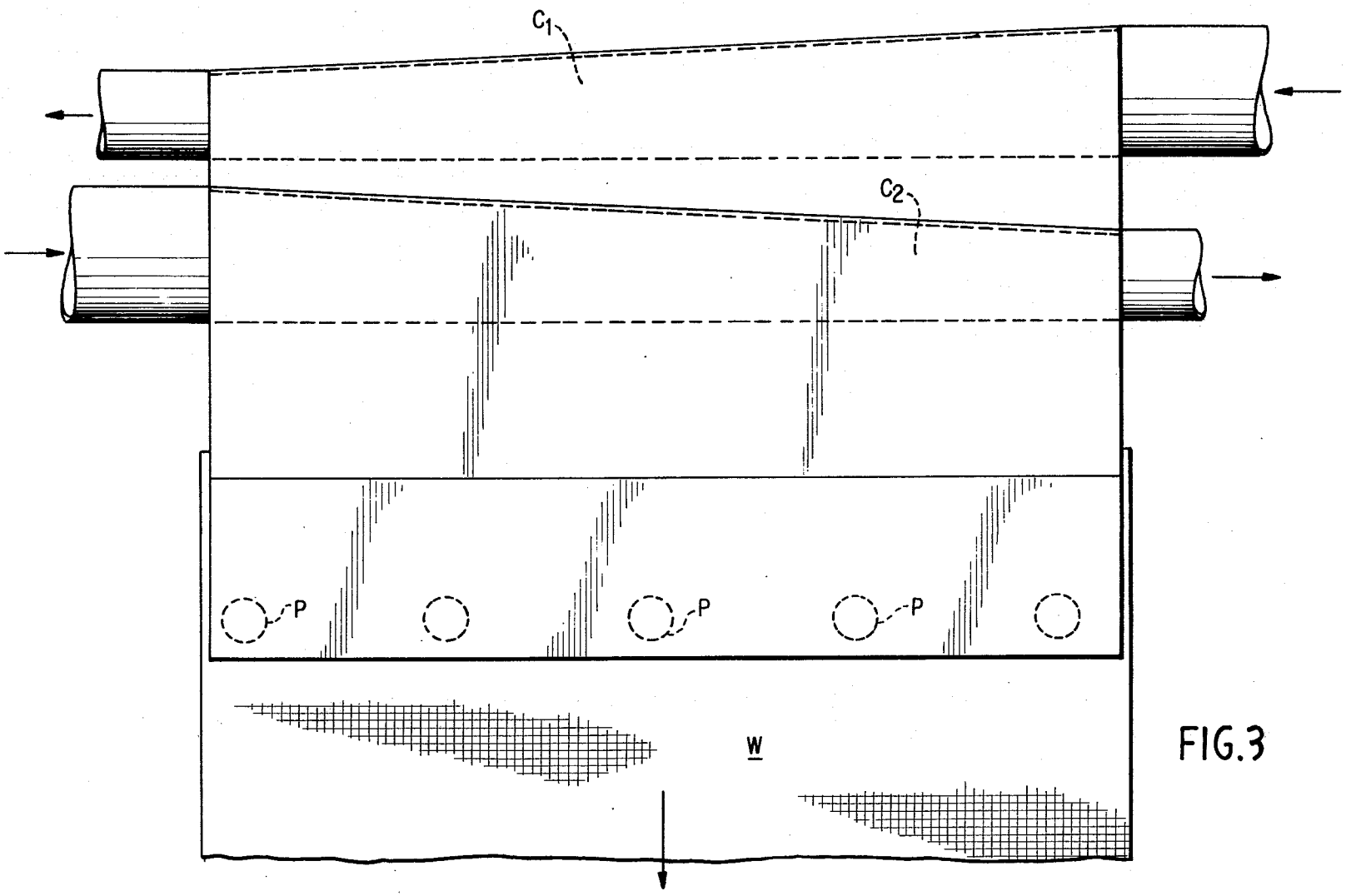

An apparatus for performing the process of the present invention is schematically illustrated in FIGS. 1, 2 and 3. In the FIGS. $C_1$ and $C_2$ are the cross-flow distributors through which the fiber suspensions are distributed to the flow box assembly, E and $P_1$. P and F represent the conduit through which the fiber suspension distributed through cross flow distributor $C_2$ is introduced into the flow box assembly at P1. W represents the forming wire conventionally associated with fiber board forming apparatus. In operation a fiber suspension of different densities or different fiber qualities are introduced into cross flow distributors $C_1$ and $C_2$. The fiber suspension introduced into $C_1$ is supplied over the entire width of wire except where pipes P having opening $P_1$ are located. At this location are strips of fiber suspension introduced into $C_2$ is formed on the wire.

When manufacturing fiber board in accordance with the present invention, for the purpose of varying the density of the strips in the machine direction, inlet or flow boxes can be arranged so that two flows of fiber suspension, hereinafter referred to as stock, alternate with each other and flow out onto the wire screen at different concentrations and/or containing fibers of different quality. The two flows are fed to the inlet or flow box separately and are, for example, introduced from different sides of the flow box E, for example one flow may be fed from one side of the flow box E, such as at $C_2$ and the other flow from the rear of the flow box E, such as at $C_1$. This method of manufacture provides the possibility of including different raw materials in the two stock flows, e.g. a fiber raw material of relatively high quality in the flow which is to provide the mat strips of high density, and an inferior bark-containing raw material of lower quality in the flow which is to form the mat strips of lower density. For the purpose of strengthening the fiber board and to stabilize it dimensionally, it is also possible in accordance with the method of the invention to supply a thermosetting resin, such as phenol resin, to the stock flow which is to form the mat portions of higher density. In accordance with a particularly suitable embodiment of the invention, the sheet is also provided with a central layer, i.e., centrally with respect to mat thickness which extends over the whole width of the sheet and which has the higher binding-agent content.

An alternative way of manufacturing mat portions having different densities, somewhat simpler than the one mentioned above, resides in varying the lip setting of the inlet box outlet to the wire, thereby varying the quantity of fiber stock which flows to different portions of the sheet over the width of the machine. This method has provided good results when the sheet-forming operation is effected at low speed and particularly when said operation is effected at high concentration and at a high degree of dewatering at the beginning of the wire screen portion. Mat portions of higher density extending transversely of the machine direction can be produced by means of a channel which extends at an angle to said machine direction and which is adapted so that a small portion of the channel opens downwardly for the discharge of fiber suspension, said discharge opening being arranged to move transversally of the machine direction at a speed which is adjusted to the speed of the machine, so that the stock is distributed perpendicularly to the machine direction.

The manufacture of board provided with mat portions of different characteristics will now be described together with methods for the manufacture of said board with reference to a number of examples.

These examples, however, are not restrictive of the invention.

EXAMPLE 1

On a machine for wet manufacturing medium density fiber building board (hardboard according to AHA specification) having a trimmed machine width of 125 cm and a sheet-forming width of 132 cm, there was arranged a flow box in a manner such that two flows of stock could be supplied, said flows leaving the flow box at mutually the same speed. One stock flow had a fiber concentration of 2.4% and the other a fiber concentration of 3.4%. The stock had a de-watering resistance of 25 Defibrator seconds. When forming a sheet, the stock having the higher concentration was supplied to form an outer surface strip of 10 cm on each side of the sheet and another three strips of 5 cm distributed uniformly over the width of the sheet at a distance of 25 cm from each other and from the outer strips of high density. At the same time there were formed four strips comprising the stock of low concentration, each of said strips having a width of 25 cm. The sheet was dewatered on wet-suction boxes and without substantial admixing of the two stock flows. The stock of high density was provided with 0.5% phenol resin based on an absolutely dry stock. The sheet was pressed to a thickness of 10 mm in a multi-stage press at 220° C for a total press time of 24 minutes. Prior to this, the wet sheet had been cut to a width of 129 cm. Subsequent to a heat treatment of 4 hours at 155° C, the sheet was cut clean to 124 cm. The finished board was perfectly flat and had, when seen totally, an average density of 650 $kg/m^3$, said board having mat portions of a density of 850 $kg/m^3$ and 600 $kg/m^3$ in the strip-like patterns before-mentioned. The resistance to bending of the board (i.e., the bending stiffness of overall modulus of elasticity) within the range of elastic stretch was 25% higher than in the case of a homogeneous board of the same thickness having a density of 650 $kg/m^3$.

EXAMPLE 2

In a machine similar to that described in Example 1 but having a normal headbox operating with only one type of stock, the outlet portion of the headbox had been rebuilt so that by means of the outlet lip great variations in the outlet height could be obtained. This lip height i.e. the opening from the discharge box was increased with 50% in 5 cm wide strips at a mutual distance apart of 10 cm above adjacent surface portions. The concentration of the stock in the head box was 4.1% and the surface stock was covered with 200 $g/m^2$ of a highly ground fibrous raw material, the basic stock comprising sawdust stock having a de-watering resistance of 26 Defibrator seconds. Medium density fiber board (hardboard according to AHA specification) having a thickness of 10 mm were manufactured in the manner described in Example 1, whereupon strip-like surface portions having a density of 500 and 700 $kg/m^3$ respectively, were obtained. The boundaries between these surface portions were not quite as well defined as with the surface portions of Example 1, said surface portions constituting ⅓ and ⅔ of the surface respectively and the board was completely flat. The average density of the board, as seen totally, was 570 kg/m³. The resistance to the bending and overall elasticity of the board was 30% higher than a homogeneous board manufactured with a density of 570 kg/m³ of the same thickness.

EXAMPLE 3

Subsequent to being de-watered and prior to being pressed in laboratory equipment constructed for this purpose, a wet sheet manufactured in accordance with Example 1 was provided with strips of stock extending in the machine direction. A further 750 g of stock per m² was applied in strips of 15 cm width transversely of the machine direction and at a mutual distance apart of 35 cm. The wet sheet was again wet-pressed and passed through the manufacturing process. The board was sawn so to provide an edge strip of high density extending peripherally around the sheet. In this way an improved density was obtained, which manifested itself in the small amount of paint required to paint the edges thereof. The screw strength of the edges was tested in accordance with Medd. STTI 79 B (1971) (FS:9B) whereupon the screw holding strength of the strips of high density was found to be 25% higher than in a board having the same total average density.

EXAMPLE 4

In a machine having a modified head box according to Example 1, there ware supplied two flows of mutually different stock having a density of 2.5%. As with the previous examples, one of said stocks was supplied so as to provide two outer strips of 10 cms on each side of the sheet and three strips of 5 cms uniformly spaced over the width of the sheet and 25 cms from respective outer strips. This stock comprised debarked pine, beaten to 35 Defibrator seconds with regard to the de-watering time and admixed with 1.5% phenol resin calculated as bone dry and based on bone dry stock. The other stock flow was based on conventional bark-containing raw material comprising saw-mill waste and refined to a de-watering time of 25 Defibrator seconds. A medium density building board (hardboard according to AHA specification) and having a density of 700 kg/m³ was produced and heat hardened at 160° C. A normal sheet comprising solely this latter stock had a modulus of elasticity of 2.4 GPa (24,000 kg./cm²) and an internal bonding strength of 0.20 MPa (2.0 kg/cm²). The introduction of the two flows of mutually different stock increased the modulus of elasticity to 2.9 GPa (29,000 kg/cm²) and the internal bonding strength at the strips comprising highly-beaten stock admixed with phenol resin to 0.45 MPa (4.5 kg/cm²).

I claim:

1. In a method of manufacturing wet-pressed fiber board material of uniform thickness in which a layer of fiber-water suspension is prepared, said layer being de-watered and pressed to form a coherent flat sheet, the improvement comprising distributing said fiber-water suspension over the surface of said layer in a manner such that the pressed board product contains strip-like surface portions which extend in at least one direction of the horizontal plane of the sheet, said strip-like surface portions having varying densities, whereby the finished board has a higher resistance to bending than a homogeneous sheet having substantially the same average density.

2. The method of claim 1 in which the fiber layer is formed by de-watering the suspension on a wire screen, wherein fiber suspensions having different fiber concentrations are supplied to the wire screen at the same speed from a sectioned head box in a manner such that the board obtained contains strip-like surface portions of mutually different densities extending in the machine direction.

3. The method of claim 2, wherein the difference in densities of the strip-like surface portions is at least 20%.

4. The method of claim 3, wherein the difference in the densities of the strip-like portions is at least 30%.

5. The method of claim 3, wherein the surface portions of higher density are provided with a binding agent.

6. The method of claim 5, wherein said binding agent is a thermosetting resin.

7. The method of claim 2, wherein the surface portions of higher density comprise a raw fibrous material which has greater mechanical strength than the surface portions of lower density.

8. The method of claim 2, wherein the board comprises multiple layers, and the center layer of the board is provided with a binding agent over the whole width of the board.

9. The method of claim 2, wherein surface portions of higher density are situated at positions on the sheet which are to form the two of the outer edges of a board which has been sawn to the desired size.

10. The method of claim 2, wherein the surface portions of higher density constitute 10–50% of the total surface of the board.

11. The method of claim 10, wherein said surface portions of higher density constitute 15–30% of the total surface of the board.

* * * * *